United States Patent [19]

Nagel

[11] Patent Number: 4,545,007

[45] Date of Patent: Oct. 1, 1985

[54] LUMINAIRE WITH LENTICULAR LENS

[75] Inventor: Robert Nagel, Mesa, Ariz.

[73] Assignee: Devine Lighting, Kansas City, Mo.

[21] Appl. No.: 649,576

[22] Filed: Sep. 12, 1984

[51] Int. Cl.[4] ..... F21V 7/04

[52] U.S. Cl. ..... 362/329; 362/309; 362/338; 350/259

[58] Field of Search ..... 362/329, 339, 337, 338, 362/330, 309; 350/259; 352/67

[56] References Cited

U.S. PATENT DOCUMENTS

| | | | |
|---|---|---|---|
| 65,817 | 6/1867 | Kitchen | 362/339 |
| 595,273 | 12/1897 | Soper | 350/259 |
| 1,259,492 | 3/1918 | Dorey et al. | 362/339 |
| 1,751,984 | 3/1930 | Eskilson | 362/337 |
| 1,969,982 | 8/1934 | Lehman | 362/329 |
| 2,086,182 | 7/1937 | Dvornik | 352/67 |
| 2,183,249 | 12/1939 | Schering et al. | 362/337 |
| 2,229,693 | 1/1941 | Dietrich | 362/329 |
| 2,907,249 | 10/1959 | Hjermstad | 362/329 |
| 3,222,516 | 12/1965 | Miles | 362/338 |
| 3,267,278 | 8/1966 | Doolittle | 362/309 |
| 3,357,770 | 12/1967 | Clay | 350/131 |
| 3,794,829 | 2/1974 | Taltavull | 362/330 |
| 4,471,412 | 9/1984 | Mori | 362/329 |

FOREIGN PATENT DOCUMENTS

| | | | |
|---|---|---|---|
| 555654 | 4/1958 | Canada | 362/339 |
| 956568 | 1/1957 | Fed. Rep. of Germany | 362/339 |
| 2846842 | 4/1980 | Fed. Rep. of Germany | 362/339 |

*Primary Examiner*—Raymond A. Nelli

*Attorney, Agent, or Firm*—Seidel, Gonda & Goldhammer

[57] ABSTRACT

A luminaire includes a lenticular lens. Each lentical comprises a convex lens having a highly polished aspheric curved surface. The aspheric surface is divided into a plurality of coaxial zones, each designed to accept a specific quantity of parallel light flux from a parabolic reflector positioned within the luminaire and then refract that quantity of flux into a specific solid angle of the projected beam. The convergence of light rays by each lens element produces a real image of the light source in front of the lenticular lens. Each lentical produces a separate image and all images were substantially identical.

7 Claims, 5 Drawing Figures

LUMINAIRE WITH LENTICULAR LENS

BACKGROUND OF THE INVENTION

This invention relates to luminaire lighting, and more particularly, a lenticular lens for high intensity flood or area lighting with precise beam control. The design of luminaires for high intensity lighting presents certain difficult problems in obtaining good luminance without undesirable bright spots. Typically, luminaires for flood or area lighting use shaped specular reflectors which redirect incident light flux from an intense light source to form a desired beam. Conventional reflector shapes are parabolic, for a narrow beam; elliptical, hyperbolic and spherical, for a wide beam; or a combination of sections of the four shapes. The function of the reflector is to distribute the light both functionally and efficiently. The difficulty is that an observer sees two segments of light: the source itself and a reflected image of the light source. Although these segments represent only a small fraction of the total luminaire face, they produce high source brightness or direct glare. While this can be minimized by the use of diffusion devices, such as frosting or pebbling, this often results in loss of beam control. Also, such anti-glare devices tend to spread the light beyond desired beam angles thereby reducing the efficiency of the luminaire.

Yet another disadvantage of beam control by the use of reflectors is that blemishes or defects in the reflector or the face may cause shadows, bright spots, or other non-uniform areas in the beam. Moreover, at some angles the light source itself may be obstructed by the reflector or fixture housing.

The present invention is intended to overcome the foregoing difficulties in a high intensity luminaire for flood or area lumination. The present invention is particularly suited for use with high intensity light sources such as the so-called halogen light sources.

BRIEF SUMMARY OF THE INVENTION

In accordance with the present invention, there is provided a lenticular lens for distributing the high intensity light flux over the entire face of the luminaire. The luminaire itself comprises a parabolic reflector with the light source positioned at or near its focus. Incident light flux is reflected in a parallel direction by the reflector through the lenticular lens. The lens itself refracts parallel rays reflected from the reflector by means of aspheric curved surfaces on each lens element, or lentical, to a focal point directly in front of the lentical. Since each lentical distributes the light rays only in a predetermined cone, maximum efficiency is obtained. The observer sees a multiple of tiny light images of the light source with a dark surround. In fact, the lenticular lens functions as if the luminaire had as many light sources as there are lenticals. If, for example, a lenticular lens contains 2,000 identical lenticules, the light passing through the lens forms 2,000 separate images. Each image is 1/2,000ths of the total flux of the fixture. When viewed from any normal viewing angle, the lens appears to have a multitude of tiny light images, each with a dark surround. The result is a minimum brightness from any viewing angle. Each lentical independently produces a complete distribution of light and the amount of light distributed by each lentical has the same pattern as every other lentical.

More specifically, the lenticular lens comprises a plurality of continuous polygonal lens elements with each element comprising a highly polished aspherical curved entrance surface and a flat exit surface. The aspheric surface of each lentical is divided into a number of coaxial zones, each designed to accept a specific quantity of light flux from the parabolic reflector and refract that quantity of flux into a specific solid angle of the projected beam. By controlling the direction of the light rays eminating from various zones of the lens, desired distribution of light is achieved. The convergence of light rays by each lenticular lens element produces a real image of the light source in front of the lenticular lens and all images are substantially identical. The geometric light distribution from all images is also identical.

Thus, in accordance with the present invention there is provided a lenticular lens for a luminaire comprising a plurality of contiguous polygonal lens elements, each element having a light receiving end and a light transmitting end. The light receiving end of each element is substantially aspherical and is defined by a plurality of coaxial arcs of differing radii. The exit end of each lentical is substantially flat. Each lentical or lens element is preferably hexagonal so that they can be arranged in abutting relation to each other.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
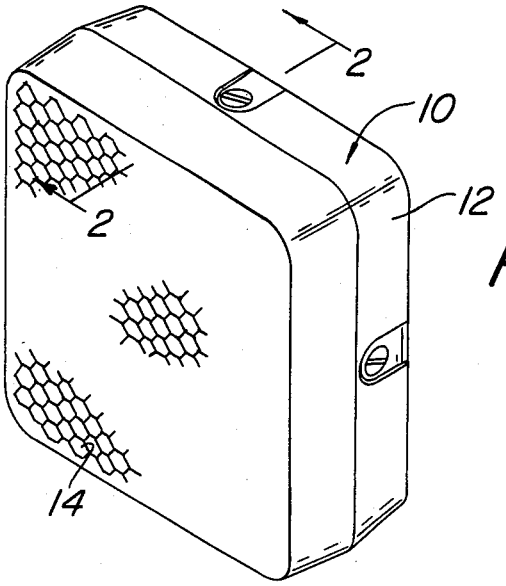
FIG. 1 is a perspective of the luminaire of the present invention.

The present invention is best understood by referring to the drawings wherein like numerals indicate like elements.

Referring to FIG. 1, there is shown a luminaire 10 comprising a casing 12 with the lenticular lens 14 mounted in its front face.

Figure 2:
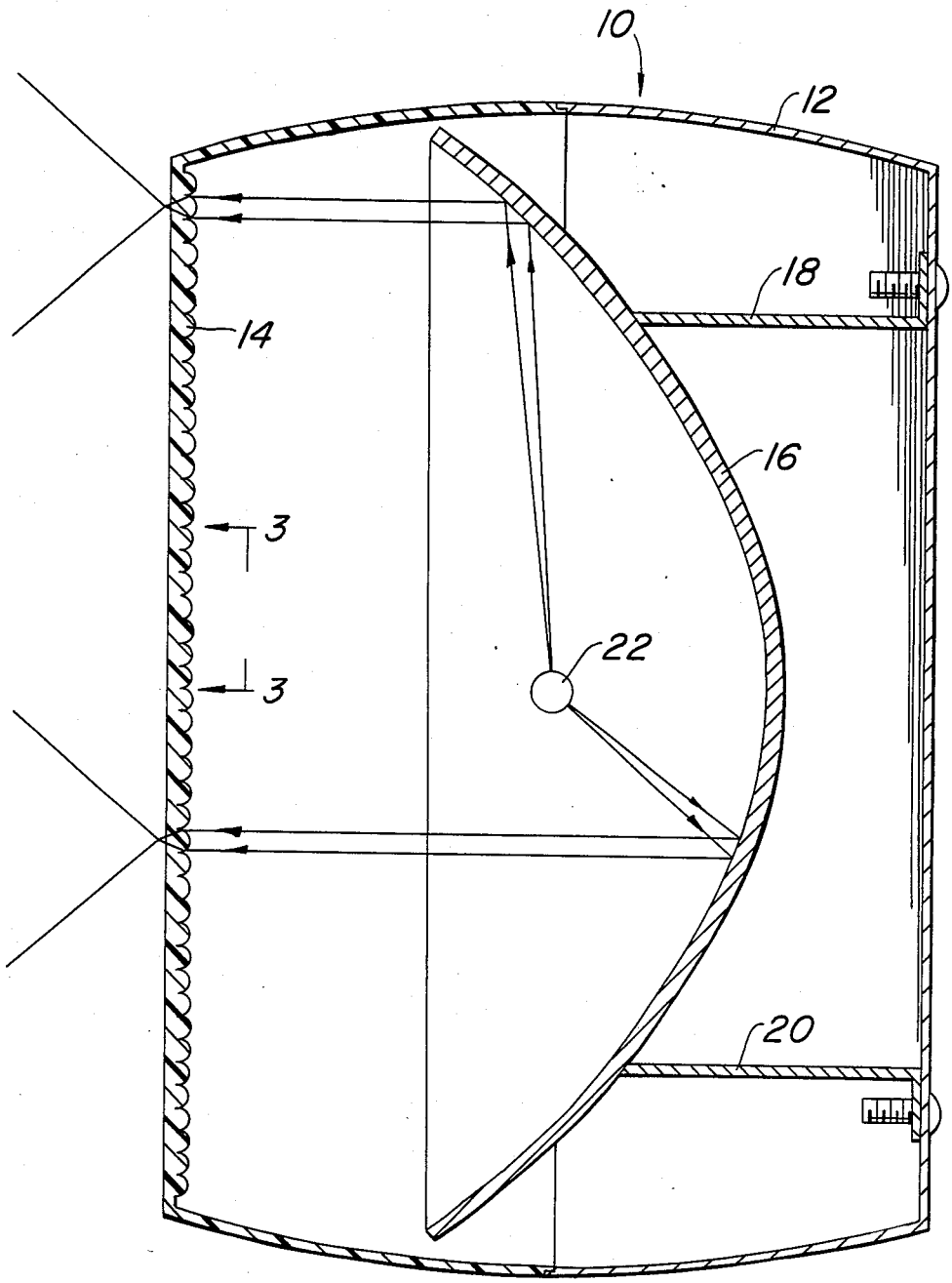
FIG. 2 is a transverse sectional view of the luminaire shown in FIG. 1 taken along the line 2—2.

As best shown in FIG. 2, the luminaire 10 includes a parabolic reflector 16 held in position by a pair of brackets 18 and 20 fixed to the rear of casing 12 by threaded fasteners. The luminaire 10 is also provided with an appropriate socket (not shown) for supporting an alkaline metal type lamp such as high power sodium or mercury vapor at or near the focus of the reflector 16. As is well known, light flux emitted from the lamp 22 is reflected by the parabolic reflector 16 as parallel rays passing through the lenticular lens 14. The lens 14 is fixed in the front surface of a casing 12 by any conventional means.

In as much as the ballast and electrical connections for the lamp 22 are conventional, and play no part in the present invention, they have not been illustrated.

Figure 3:
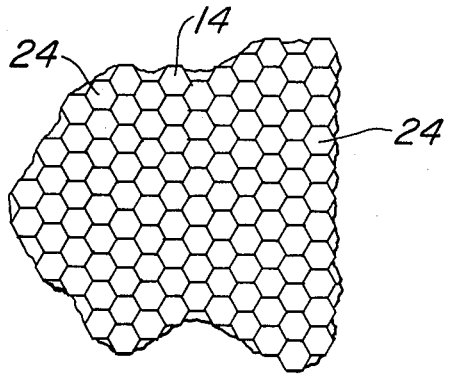
FIG. 3 is a partial front view of the lenticular lens in accordance with the present invention.

As shown in FIG. 3, the lenticular lens 14 comprises a plurality of lenticals 24 which are hexagonal in cross section. The hexagonal cross sectional shape is chosen so that each lentical is fully contiguous with every other lentical except of course those on the edge of the lens 14. Although the hexagonal cross sectional shape is preferred, other shapes may be chosen.

Figure 4:
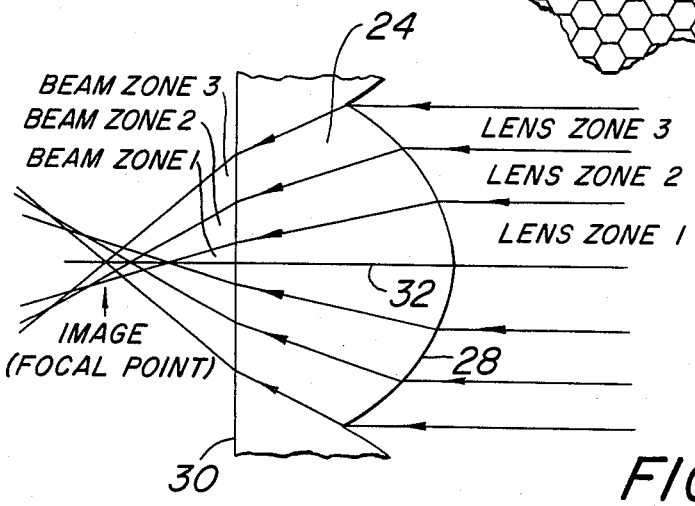
FIG. 4 is an enlarged, transverse sectional view of the lenticular lens showing one of the lenticals.

Each lentical is identical to every other lentical. A typical lentical 24 is illustrated in FIG. 4. Each lentical 24 comprises an aspheric light entrance surface 28 and a flat light exit surface 30. Each light entrance surface is convex and comprises a set of highly polished aspherical curved surfaces divided into a number of coaxial zones. Each zone accepts a specific quantity of parallel light flux from the reflector 16 and refracts that flux into a specific solid angle of the projected beam. As shown in FIG. 4, parallel light rays strike the lentical 24 and are refracted to form an image of the light source in front of the lenticular element. The image need not be sharply focused.

In accordance with the present invention, the exemplary concave entrance surface 28 is divided into three co-axial zones labeled lens zone 1, lens zone 2 and lens zone 3. Each lens zone has a different radius of curvature but is coaxial with the lenses central axis of the lens 32. Thus, parallel flux entering lens zone 3 is refracted by the lentical 24 and exits at beam zone 3. Parallel light entering lens zone 2 is refracted and exits at beam zone 2. Parallel flux entering lens zone 1 is refracted and exits at beam zone 1. Of course, additional zones may be used as desired.

The precise radius of curvature for each lens zone can be varied depending upon the desired angle of flux distribution. The entrance surface should be highly polished.

Figure 5:
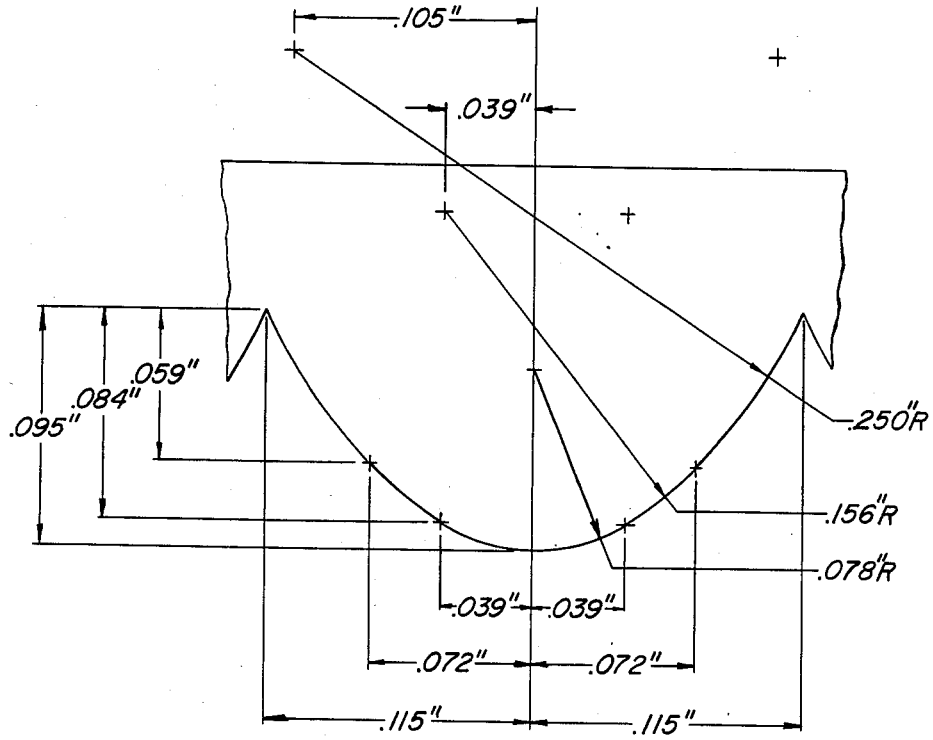
FIG. 5 is an enlarged, transverse sectional view of one of the lenticals showing its basic dimensions.

By way of example, but not limitation, FIG. 5 shows the dimensions of a lentical for a lenticular lens to be used as a flood light. The following is a table of the dimensions for a typical lentical for a lenticular lens used as a flood lamp in accordance with the present invention.

| | Radius Of Curvature | Distance From Axis |
|---|---|---|
| Lens Zone 1 | .078" | .0 to .039" |
| Lens Zone 2 | .156" | .039" to .072" |
| Lens Zone 3 | .250" | .072" to .115" |

Hexagonal cross sectional shape
Vertical spacing - each lenticule .2000"
Horizontal spacing - each lenticule .1732"

It should be noted that the cross-over of light rays in front of the lenticular lens does not necessarily form a sharp image of the light source. The degree of sharpness of focus depends upon the light distribution desired. By controlling the shape of each zone on the entrance surface, light is refracted into a desired beam zone. The angular spread of the beam zones combined with the quantity of flux in each zone determines final beam distribution of the lentical. Since all lenticals are identical and all light incident on the lenticular lens is substantially parallel, it follows that the beam spread characteristics from all elements are identical.

Luminaires constructed with lenticular lenses made in accordance with the present invention have demonstrated excellent light distribution qualities. A flood luminaire with a 50 watt high pressure sodium lamp projects approximately 800 candelas at 35° horizontally. Observers viewing an 8½" by 8½" lenticular lens see 800 candelas spread throughout the entire projected face area of the luminaire. Photographic examinations show that each lentical appears to be an individual light source with a dark surround. By comparison, a conventional flood light viewed at the same angle appears to project all 800 candelas from a small portion of the total projected face area.

As previously indicated, each lentical acts as a mini light source, and there are as many light sources distributed across the face of the lenticular lens as there are lenticals. Each of these light sources produces a complete distribution of light independently. If for example, the beam produced by the luminaire 10 is 127° horizontal by 127° vertical then each individual lens element also produces 127° by 127° beam, but in any given direction the candelas produced by one lentical is a fraction of the total candelas of the luminaire and conversely the candelas intensity of the luminaire in any direction is the total of all of the individual candelas from all of the lens elements in that direction. Obviously, the candelas intensity in any direction eminates from light sources spread throughout the total face area of the luminaire and therefore maximum surface brightness is always at the minimum possible, since candelas per square inch are always candelas divided by the full projected area of the lenticular lens.

A conventional flood light using a specular reflector with a clear glass cover plate, having equal distribution, will project the 800 candelas at 35° horizontal from a small portion of the total projected face area. With the same clear 50 watt sodium lamp having an arc brightness of approximately 1,900 candelas per square inch, a perfectly specular reflector will project 800 candelas from a total area of: 800 candelas/1900 candelas per square inch/0.85R/0.90T=0.55 square inches (where R is the reflection factor of a typical reflector and T is the transmission factor of a typical glass plate. Maximum brightness in this case is: 800 candelas/0.55 square inches=1450 candelas per square inch or 1450×144=208,800 maximum candelas per square foot (foot lamberts).

The above analysis is partly theoretical and assumes ideal optical condition, but it illustrates the fact that the lenticular lens system of the present invention produces substantially lower maximum brightness than conventional luminaires.

The present invention may be embodied in other specific forms without departing from the spirit or essential attributes thereof and, accordingly, reference should be made to the appended claims, rather than to the foregoing specification, as indicating the scope of the invention.

I claim:

1. A lenticular lens for distribution of light comprising a plurality of contiguous polygonally-perimetered lens elements, each said lens element having a light entrance surface and a light exit surface, said light entrance surface comprising an aspherical surface defined by a plurality of coaxial zones of different predetermined radii, said light exit surface being substantially planar.

2. A lenticular lens according to claim 1 wherein said light transmitting portion of each lentical is a continuous, smooth, polished surface.

3. A lenticular lens according to claim 1 wherein the number of coaxial arcuate zones is three (3).

4. A lenticular lens according to claim 3 wherein the radii of the arcuate zones measures 0.25", 0.156" and 0.078", respectively.

5. A lenticular lens according to claim 4 wherein the radial width of said zones is measured from the axis of each lentical is respectively 0.0 to 0.039"; 0.039 to 0.072"; and 0.072" to 0.115".

6. A lenticular lens according to claim 1 wherein each lens element perimeter is hexagonal.

7. A luminaire for high intensity light comprising a casing, a parabolic reflector positioned within said casing, means for supporting a high intensity lamp at the focal point of said reflector, and a lenticular lens positioned as the face plate of said luminaire, said lenticular lens comprising a plurality of contiguous polygonally-perimetered lens elements, each lens element having a light entrance surface and a light exit surface, said light entrance surface being substantially aspheric and being defined by a plurality of coaxial arcuate zones of differing radii, said light transmitting surface being substantially planar.

* * * * *